United States Patent [19]

Litzinger

[11] 4,266,561

[45] May 12, 1981

[54] TOBACCO SMOKE FILTERING COMPOSITIONS

[75] Inventor: Elmer F. Litzinger, Louisville, Ky.

[73] Assignee: Brown & Williamson Tobacco Corporation, Louisville, Ky.

[21] Appl. No.: 895,220

[22] Filed: Apr. 10, 1978

[51] Int. Cl.[3] ..... B01D 53/14; B01D 59/28; A24D 3/14; A24D 3/16

[52] U.S. Cl. ..... 131/341; 131/342; 55/387

[58] Field of Search ..... 131/10 R, 10.7, 10.9, 131/11, 17, 261 R, 261 A, 261 B, 263, 264–269

[56] References Cited

U.S. PATENT DOCUMENTS

| | | | |
|---|---|---|---|
| 2,792,841 | 5/1957 | Larson | 131/265 |
| 3,251,365 | 5/1966 | Keith et al. | 131/10.9 |
| 3,417,759 | 12/1968 | Touey et al. | 131/267 |
| 3,460,543 | 8/1969 | Keith et al. | 131/266 |
| 3,550,600 | 12/1970 | Horsewell et al. | 131/267 |

*Primary Examiner*—V. Millin

*Attorney, Agent, or Firm*—Charles G. Lamb; William J. Mason

[57] ABSTRACT

The disclosure is of compositions useful for chemisorption of undesirable chemical compounds found in tobacco smoke. The compositions comprise a base of alumina (aluminum oxide) impregnated with various proportions of zinc acetate, acetic acid and polyethyleneimine. The compositions are usefully employed as chemical filter components and are particularly advantageous in that they have a capacity to remove large quantities of hydrogen cyanide and hydrogen sulfide from tobacco smoke while simultaneously removing acetaldehyde. Unexpectedly the smoking quality of cigarettes, to which the compositions may be associated, is not adversely affected. To the contrary, smoking quality of such cigarettes is improved.

15 Claims, 2 Drawing Figures

TOBACCO SMOKE FILTERING COMPOSITIONS

BACKGROUND OF THE INVENTION

1. Field of the Invention

The invention relates to chemisorptive compositions and more particularly relates to chemisorption compositions useful to filter gaseous vapors such as tobacco smoke and remove select chemical compounds.

2. Brief Description of the Prior Art

As is well known, tobacco smoke consists of a gaseous or vapor phase in which are suspended liquid or semi-liquid droplets or solid particles, which form the visible smoke stream. Conventional cigarette filters are formed from cellulosic fibers or convoluted creped paper formed into a cylindrical plug to remove varying proportions of the droplets passing therethrough. For the most part, they do not effectively remove gaseous molecules.

Such gaseous molecules, including hydrogen cyanide and hydrogen sulfide can be considered as gases or highly volatile liquids. In the brief period of time in which they are carried from the tobacco combustion zone to the smoker's mouth, there is relatively little time for the gases to condense into droplets. Consequently, these materials are almost entirely found in the vaporized state as they leave the smoking article and enter the smoker's mouth. The smooth and generally non-porous nature of commonly used fibrous filtering materials may capture tobacco smoke droplets, but do not present a sufficient surface area to effectively adsorb gaseous molecules.

In an attempt to improve the adsorptive properties of conventional tobacco smoke filters, various adsorbents have been proposed for ordinary filtering materials. In U.S. Pat. Nos. 3,251,365 and 3,460,543 it is disclosed that zinc oxide may be added to high surface area filter supports such as charcoal or activated alumina for a smoking article. Such high surface area adsorbents have an adverse effect on taste; i.e., they remove flavor compounds in addition to hydrogen cyanide and hydrogen sulfide.

U.S. Pat. No. 4,022,223 also teaches the use of alumina and activated alumina as base materials in absorptive filter compositions. Furthermore, U.S. Pat. No. 4,022,223 teaches active alumina—polyethyleneimine complexes with other ingredients.

In the U.S. Pat. No. 3,403,690 disclosure is made of filters for tobacco smoke which comprise fibrous, filamentary or sheet tobacco smoke filtering material treated with nine salts including zinc acetate. The filters have enhanced efficiency for removing hydrogen sulfide and hydrogen cyanide.

In U.S. Pat. No. 3,550,600, zinc acetate is combined with a base such as polyethyleneimine in a tobacco smoke filter support. The presence of the polyethyleneimine is said to improve the efficiency in removal of hydrogen sulfide, hydrogen cyanide and steam volatile phenols.

Polyethyleneimine has also been used on filter supports alone; see U.S. Pat. Nos. 3,340,879 and 3,716,063 (the latter using polyethyleneimine buffered with acetic acid).

Other teachings representative of the prior art are the disclosures of U.S. Pat. Nos. 3,618,619; 3,716,500; 3,802,441; and 3,898,322.

In general, the prior art absorptive or chemisorptive compositions useful to filter tobacco smokes are effective in removing one or more undesirable chemicals from tobacco smoke, such as hydrogen cyanide or aldehydes. However, the prior art compositions are generally not efficient in removing large quantities of a broad variety of different undesirable smoke components simultaneously. The compositions of the present invention are efficient in removing hydrogen sulfide, hydrogen cyanide and acetaldehyde in large quantities, simultaneously. Unexpectedly, when the compositions of the invention are associated with smoking products such as cigarettes and the like, the quality of the smoking, i.e., taste, is improved.

SUMMARY OF THE INVENTION

The invention comprises a composition, which comprises alumina impregnated with polyethyleneimine, acetic acid and zinc acetate.

The invention also comprises tobacco smoke filters incorporating the compositions of the invention as chemisorptive components and smoking products associated with such filter components.

The term "smoking products" as used herein includes cigarettes, cigars, pipes and the like.

The terms "chemisorptive" and "chemisorption" as used throughout the specification and claims means a composition or process whereby a composition filters a gas by a combination of physical adsorption and chemical reaction.

The chemisorptive compositions of the invention may be prepared by first providing alumina (aluminum oxide) preferably having a particle size of from about 20 to about 50 mesh. The alumina is a porous carrier base for the compositions of the inventions and preferably is selected to have pore sizes of from about 0.1 to 2.0 microns. Advantageously the pore volume of the substrate alumina is not less than about 0.3 cubic centimeters per gram. Below this level, selective removal of tobacco smoke compounds such as aldehydes is diminished. Alumina with the above-described pore sizes and volumes have surface areas in the range of from about 1 to 50 square meters per gram.

The alumina may be combined first with the polyethyleneimine (hereinafter referred to at times as "PEI") by immersing the alumina in an aqueous solution of the polyethyleneimine and thereafter drying the treated alumina to drive off the water solvent. The remaining polyethyleneimine is physically absorbed on the alumina carrier. This absorption is preferably carried out in a manner so as to add on polyethyleneimine to the alumina in a proportion of from about 2 to about 9 percent by weight of the alumina, preferably about 5 percent.

The acetic acid and zinc acetate may be conveniently added to the polyethyleneimine—alumina by preparing an aqueous solution of the acetic acid with the zinc acetate and spraying it onto the polyethyleneimine—alumina. This is conveniently carried out using rotating particle coating equipment. Preferably this admixture adds zinc acetate onto the alumina in a proportion of from 0.5 to 5 percent by weight of alumina, preferably 1 to 2 percent and most preferably about 1 percent. The proportion of acetic acid added on is advantageously that which would give a final pH of from about 6.0 to 7.6. After addition, the resulting product may be dried under vacuum.

The above-described compositions of the invention may be advantageously used as a chemisorptive filter material for smoking articles such as cigarettes. For example, they may be dispersed onto a fibrous filter support material such as fibers of regenerated cellulose, polyamides, polyesters, cellulose acetate, proteins, polyvinyl resins, acrylic resins and the like. It is advantageous to uniformly disperse the compositions of the invention throughout the fibrous filter compositions component. The techniques of dispersing a granular filter material in a fibrous component by dusting, spraying, slurrying and like methods are so well known that they need not be described in detail herein. Such techniques are commonly employed in making so-called "dual filters" wherein a crimped cellulose acetate tow is bloomed and then dusted with a granular filter material.

BRIEF DESCRIPTION OF THE DRAWING

Referring to the drawing.

DESCRIPTION OF THE PREFERRED EMBODIMENTS

Figure 1:
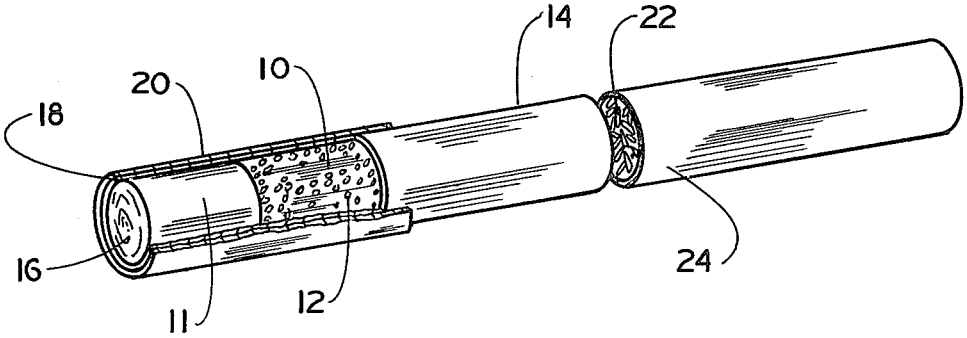
FIG. 1 is a perspective view, partially cut away, of a preferred filtering composition of the present invention attached to a cigarette; and, FIG. 2 is an isometric view, partially cut away, of another preferred filtering composition of the present invention.

In FIG. 1, a cigarette 14 is attached to a filter 16 formed of fibers 10 and 11 enclosed by a filter wrapper 18 and a cork tip 20. The fibers 10 are generally cellulose acetate with particles 12 of alumina treated with polyethyleneimine, acetic acid and zinc acetate, i.e., particles of compositions of the present invention distributed therethrough whereas the fibers 11 are also generally cellulose acetate without the inclusion of particles 12 therethrough. Producing the filter 16 with two sections or portions of fibers 10 and 11, as shown, prevent particles of treated alumina from coming in contact with the smoker's mouth. The filter 16 is attached to a tobacco rod 22 enclosed by cigarette wrapper 24. The methods and apparatus for forming fibrous materials into filter units and attaching them to tobacco rods to form cigarettes 14 are well known to those skilled in the art and details need not be given here.

Alternatively, the compositions of the invention may be incorporated as the granular component of the so-called "pocket" filters, the preparation of which is described, for example, in U.S. Pat. No. 3,844,200 (Sexstone); see also U.S. Pat. No. 3,837,264 (Sexstone). The compositions of the invention may also be used in the so-called "triple filter" wherein a composition of the present invention is interposed between two filtering mediae of other filtering materials, i.e., cellulose acetate.

Figure 2:
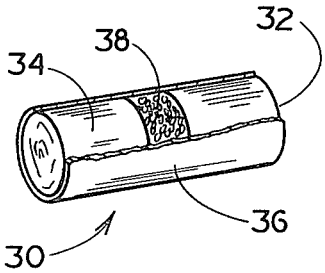

In FIG. 2, a filter 30 including loose particles 38 of a composition of the present invention is encased in an outer filter wrapper 36. The open ends of wrapper 36 are closed with porous filter plugs 32 and 34. Preferably plugs 32, 34 are conventional cellulose acetate filters, but they may simply be porous papers. The filter 30 may be attached to a smoking article, such as a cigarette, to filter the tobacco smoke when the cigarette is smoked. Methods and apparatus for smoking filters 30 and attaching them to cigarettes are well known to those skilled in the art.

Advantageously, filters for cigarettes including the compositions of the invention as chemisorption filter components will contain from about 50 to 200 mg. of the compositions of the invention, preferably about 100 mg.

The following preparations and examples describe the manner and process of making and using the invention and set forth the best mode contemplated by the inventor of carrying out the invention, but are not to be construed as limiting. All parts are by weight unless otherwise stated.

PREPARATION 1

Manganese Acetate

A first solution of manganese acetate was prepared by dissolving 16.867 gms. of the acetate in 200 ml. of 2.05 N acetic acid.

PREPARATION 2

Manganese Acetate

The procedure of Preparation 1, supra, was repeated except 33.733 gms. of the acetate was dissolved.

PREPARATION 3

Cobalt Acetate

The procedure of Preparation 1, supra, was repeated except that the manganese acetate as used therein was replaced with 17.1440 gms. of cobalt acetate.

PREPARATION 4

Cobalt Acetate

The procedure of Preparation 3 was repeated except that 34.288 grams of cobalt acetate was employed.

PREPARATION 5

Nickel Acetate

The procedure of Preparation 1 was repeated except that the manganese acetate as used therein was replaced with 17.1274 gms. of nickel acetate.

PREPARATION 6

Nickel Acetate

The procedure of Preparation 5 was repeated except that 34.295 gms. of nickel acetate was used.

PREPARATION 7

Zinc Acetate

The procedure of Preparation 1, supra, was repeated except that the manganese acetate as used therein was replaced with 15.1136 gms. of zinc acetate.

PREPARATION 8

Zinc Acetate

The procedure of Preparation 7, supra, was repeated except that 30.227 gms. of zinc acetate was used.

PREPARATION 9

Copper Acetate

A solution of copper acetate was prepared by dissolving 16.093 gms. of copper acetate in 330 ml. of water and mixing the aqueous solution with 400 ml. of 1 N acetic acid.

PREPARATION 10

Copper Acetate

The procedure of Preparation 9, supra, was repeated except that 44.564 gms. of copper acetate was dissolved in 675 ml. of water which was then added to 1 liter of the acetic acid.

PREPARATION 11

Polyethyleneimine Solution

A solution of polyethyleneimine was prepared by admixture of 5 parts in 100 parts of water.

PREPARATION 12

Alumina/Polyethyleneimine

To 100 parts of alumina (20 to 50 mesh with a pore volume of about 0.5 cc/gm.) there was added 100 parts of the polyethyleneimine solution of Preparation 11, supra. The resulting mixture was stirred until the solution was adsorbed and then the mixture was dried to yield alumina with 4.8 percent by weight of polyethyleneimine.

EXAMPLE 1

The alumina/polyethyleneimine prepared in Preparation 12, supra, was divided into eleven 1 kilo batches. Eight batches were treated with one of the acetate solutions of Preparations 1–8, inclusive, by spraying 170 ml. of each acetate-acetic acid solution onto the alumina/polyethyleneimine in a rotating 5 liter Morton flask. One batch was treated in the same manner except with a spray of 170 ml. of 2.05 N acetic acid as a control. One batch was treated by spraying 330 ml. of Preparation 9 (copper acetate) on the alumina/polyethyleneimine and adjusting the resulting composition to a 14 percent moisture content by vacuum drying. The last batch was similarly treated except with 675 ml. of the Preparation 10, supra. The treatments provide (with the exception of the control) a finished product containing 14 percent by weight water, 11.6 meq. acetic acid per gram of polyethyleneimine (half neutralization) and 5 to 10 μM of the appropriate metal acetate per 100 mg. of finished product (a zinc acetate to polyethyleneimine mole ratio of 1:9 at the 10 μM/100 mg level and of 1:18 at the 5 μM/100 mg level).

Each batch of the above-finished product was used to fabricate filter rods in a conventional manner. The sample filter rods were weight selected (1175 mg±10) and cut into 27 mm filters to replace the standard filters of weight selected commercial cigarettes (1179±10 mg). Actual metal acetate additive weights, water content and cigarette pressure drop found upon testing the filter cigarettes is shown in Table I, below.

TABLE I

| BATCH | METAL ACETATE: | LEVEL (μM/ 100 mg.) | ADDITIVE WT.* PER FILTER (mg) | ADDITIVE $H_2O$ CONTENT (%) | CIGARETTE PRESSURE DROP** |
|---|---|---|---|---|---|
| | Control*** | 0 | 91 | 14.0 | 5.4 |
| 1. | Manganese (Prep. 1) | 5 | 91 | 13.7 | 5.4 |
| 2. | (Prep. 2) | 10 | 93 | 13.2 | 5.3 |
| 3. | Cobalt (Prep. 3) | 5 | 92 | 13.5 | 5.5 |
| 4. | (Prep. 4) | 10 | 90 | 13.2 | 5.7 |
| 5. | Nickel (Prep. 5) | 5 | 91 | 13.8 | 5.4 |
| 6. | (Prep. 6) | 10 | 91 | 13.1 | 5.6 |
| 7. | Zinc (Prep. 7) | 5 | 92 | 12.6 | 5.4 |
| 8. | (Prep. 8) | 10 | 93 | 12.3 | 5.6 |
| 9. | Copper (Prep. 9) | 5 | 93 | 18.5 | 5.5 |
| 10. | (Prep. 10) | 10 | 92 | 14.4 | 5.5 |

*Average of 40 filters/sample
**For 20 cigarettes/sample (inches $H_2O$)
***PEI/acetic acid/alumina only (no metal acetate)

EXAMPLE 2

Representative filter cigarettes prepared in Example 1, supra, were smoked to 33 mm butt length on a constant vacuum smoking machine, taking 35 ml. puffs of 2 seconds duration at one minute intervals. Filter efficiency was then determined by measurement of the weight percent of component trapped by the filter based on the total amount of the component passing through the cigarette filter. The results are shown in Table 2, below, along with the metal acetate levels in the filters and the Batch identification previously assigned in Example 1.

TABLE 2

| BATCH | Metal Acetate | Level (μM/ filter | FILTER EFFICIENCIES (%) $H_2S$ | HCN | $CH_3CHO$ | Nicotine |
|---|---|---|---|---|---|---|
| | Control* | 0 | 25 | 58 | 20 | 46 |
| 1. | Manganese | 5 | 15 | 54 | 12 | 43 |
| 2. | | 10 | 0 | 53 | 13 | 44 |
| 3. | Cobalt | 5 | 14 | 50 | 12 | 44 |
| 4. | | 10 | 14 | 40 | 4 | 43 |
| 5. | Nickel | 5 | 18 | 65 | 10 | 45 |
| 6. | | 10 | 24 | 64 | 12 | 45 |
| 7. | Zinc | 5 | 43 | 62 | 16 | 45 |
| 8. | | 10 | 51 | 66 | 15 | 43 |
| 9. | Copper | 5 | 42 | 59 | 4 | 45 |
| 10. | | 10 | 64 | 61 | 2 | 44 |

*PEI/acetic acid/alumina only (no metal acetate)

From Table 2, it will be appreciated that 10 μmole (2 mg) levels of zinc acetate and copper acetate give the best hydrogen sulfide removal. These two metal acetates roughly double the removal of hydrogen sulfide by PEI/acetic acid/alumina compositions control. Manganese, cobalt and nickel acetate do not remove significant quantities of the sulfur compound from tobacco smoke.

Zinc acetate gave the highest removal of hydrogen cyanide and acetaldehyde. Together with the hydrogen sulfide removals, zinc acetate is the best of the metal acetate additives.

EXAMPLE 3

Five individuals were asked to smoke one cigarette from each of the batches 1–10 inclusive. They were asked to record their impressions and establish a best to worst taste order in comparison to a commercial cigarette (Cellulose acetate filter). Only 5 μM of zinc acetate gives acceptable smoker response and high sulfur filtration as shown in Table 3, below with the batch identification previously assigned in Example 1.

TABLE 3

| BATCH | Metal Acetate | μM/ Filter | Comments | Best to Worst Order |
|---|---|---|---|---|
| | Control* | 0 | Bland and slightly metallic | 3 |
| 1. | Manganese | 5 | Dry and slightly bitter | 2 |
| 2. | | 10 | Bland, similar to commerical cig. | 2 |
| 3. | Cobalt | 5 | Dry, and bland, similar to commerical cig. | 4 |
| 4. | | 10 | Similar to commercial cig. | 4 |
| 5. | Nickel | 5 | Dry with some bitterness | 3 |
| 6. | | 10 | Dry but good clean taste | 1 |
| 7. | Zinc | 5 | Dry and bland, similar to commercial cig. | 4 |
| 8. | | 10 | Dry with an alkaline off-taste | 6 |
| 9. | Copper | 5 | Dry, bitter, metallic | 5 |
| 10. | | 10 | Dry, bitter, metallic | 5 |

*PEI/acetic acid/alumina only (no metal acetate)

EXAMPLE 4

Following the general procedure of Example 1, supra, a series of cigarette filters were prepared having varied molar ratios of zinc acetate content to polyethyleneimine content. The proportions of polyethyleneimine, acetic acid, alumina, and water were constant for all filters. Only the amounts of zinc acetate were varied. As a control, commercial cigarettes with a cellulose acetate filter were provided. The cigarettes were smoked on the smoking machine as described in Example 2, supra. The mole ratio of zinc acetate to polyethyleneimine, the load of chemisorptive composition per filter, the smoke deliveries and the efficiency of hydrogen sulfide, hydrogen cyanide and acetaldehyde removal are shown in Table 4, below.

TABLE 4

| Mole Ratio $Zn(OAc)_2$:PEI | Loading (mg/filter) | Deliveries(μg/cig.) $H_2S$ | $CH_3CHO$ | HCN | Removal Efficiencies (%) $H_2S$ | $CH_3CHO$ | HCN |
|---|---|---|---|---|---|---|---|
| Control | 0 | 119 | 865 | 235 | | | |
| No $Zn(OAc)_2$ | 119 | 86 | 633 | 124 | 28 | 27 | 47 |
| 1:20 | 120 | 48 | 668 | 97 | 60 | 23 | 59 |
| 1:10 | 121 | 18 | 729 | 92 | 85 | 16 | 61 |
| 1:6 | 123 | 21 | 768 | 99 | 82 | 11 | 58 |
| 1:4 | 125 | 26 | 820 | 94 | 78 | 5 | 60 |
| 1:1 | 143 | 72 | 880 | 96 | 39 | 0 | 59 |

From Table 4, above, it will be appreciated that for optimum removal of hydrogen sulfide, hydrogen cyanide, and acetaldehyde, a mole ratio of between 1:10 to 1:20 zinc acetate: polyethyleneimine is most effective.

What is claimed:

1. In a filter structure, a composition, which comprises: alumina impregnated with polyethyleneimine, acetic acid and zinc acetate wherein the proportion of polyethyleneimine is from about 2 to 9 percent by weight of alumina, the proportion of zinc acetate is from about 0.5 to 5 percent by weight of alumina and the proportion of acetic acid being sufficient to give a final pH of from 6.0 to 7.6.

2. The composition of claim 1 wherein the alumina has a pore size of from about 0.1 to 2.0 microns and a pore volume not less than about 0.3 cubic centimeters per gram.

3. The composition of claim 1 wherein the proportion of polyethyleneimine is about 5 percent and the proportion of zinc acetate is from about 1 to 2 percent.

4. The composition of claim 3 wherein the proportion of zinc acetate is about 1 percent.

5. The composition of claim 4 wherein the proportion of polyethyleneimine is about 5 percent.

6. The composition of claim 1 wherein the mole ratio of zinc acetate to polyethyleneimine is within the range of from about 1:10 to 1:20.

7. A chemisorptive composition for removal of tobacco smoke which comprises:

alumina impregnated with from about 2 to 9 percent by weight of polyethyleneimine, from about 0.5 to 5 percent by weight zinc acetate and sufficient acetic acid to give a final pH of about 6.0 to 7.6, said alumina having a pore size of from about 0.1 to 2.0 microns and a pore volume of not less than about 0.3 cc/gm.

8. The composition of claim 7 wherein the proportion of polyethyleneimine is about 5 percent and the proportion of zinc acetate is 1 to 2 percent.

9. The composition of claim 8 wherein the proportion of zinc acetate is 1 percent.

10. The composition of claim 9 wherein the proportion of polyethyleneimine is about 5 percent.

11. The composition of claim 7 wherein the mole ratio of zinc acetate to polyethyleneimine is within the range of from 1:10 to 1:20.

12. A cigarette, which comprises:

a tobacco rod enclosed by a cigarette wrapper; and a tobacco smoke filter attached to one end of said rod, said filter comprising a filter enclosure and enclosed within the enclosure a chemisorptive composition which comprises alumina impregnated with polyethyleneimine, zinc acetate and acetic acid wherein the proportion of polyethyleneimine is from about 2 to 9 percent by weight of alumina, the proportion of zinc acetate is from about 0.5 to 5 percent by weight of alumina and the proportion of acetic acid being sufficient to give a final pH of from 6.0 to 7.6.

13. The cigarette of claim 12 wherein said composition is dispersed onto a fibrous support material.

14. The cigarette of claim 12 wherein said enclosure comprises a filter wrapper, the ends of which are closed with cellulose acetate filter plugs.

15. The cigarette of claim 12 wherein said composition is in the form of granules.

* * * * *

UNITED STATES PATENT AND TRADEMARK OFFICE

CERTIFICATE OF CORRECTION

PATENT NO. : 4,266,561

DATED : May 12, 1981

INVENTOR(S) : Elmer Litzinger

It is certified that error appears in the above—identified patent and that said Letters Patent is hereby corrected as shown below:

At Column 8, line 12, claim 6, please correct the numeral "1" to read "3".

Signed and Sealed this

*Twenty-ninth* Day of *September 1981*

[SEAL]

*Attest:*

GERALD J. MOSSINGHOFF

*Attesting Officer*

*Commissioner of Patents and Trademarks*